US005358633A

United States Patent [19]

Dai et al.

[11] Patent Number: 5,358,633

[45] Date of Patent: * Oct. 25, 1994

[54] HYDRODESULFURIZATION OF CRACKED NAPHTHA WITH LOW LEVELS OF OLEFIN SATURATION

[75] Inventors: Eugene Pei-Shing Dai, Port Arthur; David E. Sherwood, Jr., Beaumont, both of Tex.

[73] Assignee: Texaco Inc., White Plains, N.Y.

[ * ] Notice: The portion of the term of this patent subsequent to Aug. 23, 2011 has been disclaimed.

[21] Appl. No.: 68,045

[22] Filed: May 28, 1993

[51] Int. Cl.[5] ..... C10G 45/08

[52] U.S. Cl. ..... 208/216 R; 208/217; 208/246; 208/247

[58] Field of Search ..... 208/216 R, 217, 230, 208/243, 244, 246, 247

[56] References Cited

U.S. PATENT DOCUMENTS 3,846,286 11/1974 Phillipson ..... 208/216 R
4,498,979 2/1985 Eberly, Jr. ..... 208/216 R

*Primary Examiner*—Paul Lieberman
*Assistant Examiner*—Lorna M. Douyon
*Attorney, Agent, or Firm*—Kenneth R. Priem; Carl G. Seutter; Cynthia L. Kendrick

[57] ABSTRACT

Hydrodesulfurization of a cracked naphtha is effected in the presence of a transition alumina support bearing a Group VIII non-noble metal oxide and a Group VI-B metal oxide, the atom ratio of Group VIII metal to Group VI-B metal being 1–8. The process of the instant invention gives high levels of hydrodesulfurization compared to prior art magnesia-containing catalysts and lower levels of olefin saturation, and less octane reduction in the desulfurized gasoline.

9 Claims, No Drawings

HYDRODESULFURIZATION OF CRACKED NAPHTHA WITH LOW LEVELS OF OLEFIN SATURATION

FIELD OF THE INVENTION

This invention relates to hydrodesulfurization of cracked naphtha. More particularly it relates to a catalytic process for selectively hydrodesulfurizing cracked naphtha characterized by decreased olefin saturation and smaller loss in octane number than has characterized prior art processes.

BACKGROUND OF THE INVENTION

As is well known to those skilled in the art, cracked naphtha (obtained as product of a cracking operation or a coking operation) may contain a significant quantity of sulfur—up to as much as 13,000 wppm; and this material contributes a substantial quantity of undesired sulfur to the gasoline pool to which it is commonly passed. It is possible to decrease the sulfur content by (i) hydrotreating the whole feedstock to the cracking/coker unit or (ii) hydrotreating the product naphtha from these units.

The first noted alternative is a "brute force" effort that is very expensive in that it requires a large hydrotreater and it consumes significant quantities of hydrogen. The second-noted alternative is a more direct approach—but unfortunately it results in undesirable saturation of the olefins (typically originally present in amount of 20 w %–50 w %) down to levels as low as 4 w %–30 w %; and this reduces the octane number of the product gasoline by as much as 1–14 units. Prior art desulfurization of full range FCC naphtha from 13,000 wppm down to 20 wppm results in a typical decrease in octane number by about 14 units. This loss in octane number associated with desulfurization has a significant impact on the octane number of the refinery gasoline pool.

Typical prior art disclosures which are directed to hydrodesulfurization include U.S. Pat. No. 4,140,626 Bertolacini and Sue-A-Quan) describe a selective hydrodesulfurization process employing a catalyst with a Group VI-B metal and a Group VIII metal deposited on a support consisting of at least 70 wt % magnesium oxide (MgO). Preferably, the Group VI-B metal is molybdenum and the Group VIII metal is cobalt. Catalyst A (a catalyst of the invention of this patent) is 3 wt % CoO/~16 wt % MoO3 on a pure MgO support. Catalyst B is a sample of commercial Criterion HDS-2A CoMo on alumina hydrotreating catalyst (with similar levels of CoO and MoO3). Catalyst A is better than Catalyst B for hydrodesulfurization (HDS). In addition, catalyst A produces better octane numbers than Catalyst B at equivalent values of HDS (in the range of 75–85% HDS); however, the improvement is only ~1.5 octane numbers. Surprisingly, for both catalysts, olefin saturation is fairly low (<~40 wt %) and octane penalties are fairly insignificant (<~2 octane numbers) for the ranges of HDS studied. Other catalysts of the invention (prepared on supports with at least 70 wt % magnesium oxide) show HDS improvements.

U.S. Pat. No. 4,132,632 (Yu and Myers) is very similar to the above described patent except that the metals loadings are restricted to 4–6 wt % for the Group VIB metal and 0.5–2 wt % for the Group VIII metal. Again, preferably, the Group VI-B metal is molybdenum and the Group VIII metal is cobalt. Catalyst I (a catalyst of the invention of this patent) is ~1 wt % CoO/~5 wt % $MoO_3$ on a pure MgO support. Catalyst II is ~3 wt % CoO/~17 wt % $MoO_3$ on a support comprising 80 wt % MgO (i.e. a catalyst of Bertolacini, described above). Catalyst I generally gives poorer HDS than Catalyst II, but, Catalyst I gives less olefin saturation and better octane numbers at around the same level of HDS (~82–84%). The incremental octane improvement is small (~1.6 octane numbers). Again, for both catalysts, olefin saturation is fairly low (<~40 wt %) and octane penalties are fairly insignificant(<~2.6 octane numbers) for the ranges of HDS studied.

A paper entitled "DESULFURIZATION OF CAT CRACKED NAPHTHAS WITH MINIMUM OCTANE LOSS" was presented at the 1978 NPRA Annual Meeting in San Antonio, Texas by Coates, Myers and Sue-A-Quan. This paper presents a good overview of the development of what Amoco called their "Selective Ultrafining Process." The paper presented about one year before the above described patents issued, mentions two catalysts (presumably from the two patents). Sulfiding technique was mentioned as a major concern. Amoco claimed that the new catalysts showed lower rates of deactivation than standard hydrotreating catalysts for HDS. Incremental octane improvements were claimed to be 4 MON and 4.5 RON at 90% HDS. The incremental octane improvements of the presentation were much larger than those shown in the subsequent patents.

The conventional catalysts for naphtha hydro- treating include CoMo, NiMo, NiW, CoMoP, and NiMoP metal oxides supported on alumina such as the commercial Criterion C-444. Magnesia supported catalysts and silica-magnesia supported catalysts are disclosed in U.S. Pat. No. 2,853,429 and U.S. Pat. No. 3,269,938, respectively. The commercial BASF K8-11 catalyst, used in the water gas shift conversion, generally contains 4 wt % CoO and 10 wt % $MoO_3$ on a magnesia-alumina-silica support. One of the common drawback of catalysts on magnesia-containing supports is the low HDS activity compared to alumina supported catalysts. It is believed that poor dispersion of $MoO_3$ on magnesia supports and low surface area of magnesia supports contribute to the low HDS activity. British patent 2,225,731 discloses hydrotreating catalysts comprising Group VI-B and Group VIII metal hydrogenation components on a support which comprises magnesia and alumina in a homogeneous phase—which catalyst is said to have an activity comparable to similar catalysts based on alumina. U.S. Pat. No. 4,962,237 issued Oct. 9, 1990 to Dow Chemical Company as assignee of D. E. Laycock is of interest.

It is an object of this invention to provide an improved hydrodesulfurization process accompanied with minimum olefin saturation. Other objects will be apparent to those skilled in the art.

STATEMENT OF THE INVENTION

In accordance with certain of its aspects, this invention is directed to a process for selective hydrode-sulfurization of a charge cracked naphtha containing paraffins, isoparaffins, aromatics, naphthenes, and olefins which comprises maintaining in a reaction zone a bed of catalyst containing a transition alumina support, containing less than 1 w % of Group I-A metal oxide and less than about 15 w % of Group II-A metal oxide, and bearing a non-noble metal oxide of Group VIII and a metal oxide of Group VI-B, the atom ratio of non-noble Group VIII metal to Group VI-B metal being 1-8:1;

passing said cracked naphtha containing paraffins, isoparaffins, aromatics, naphthenes, and olefins to said reaction zone and into contact with said bed of catalyst;

maintaining said bed of catalyst at hydrodesulfurizing conditions thereby producing a product stream of hydrodesulfurized cracked naphtha; and recovering said product stream of hydrodesulfurized cracked naphtha.

DESCRIPTION OF THE INVENTION

The charge which may be treated by the process of this invention may be a naphtha, typically a full range naphtha which is recovered from a cracking or coking unit. Typically the cracked naphtha will be recovered from a fluid catalytic cracking FCC unit. The charge naphthas which may be treated may be characterized by the following properties:

TABLE

| Condition | Broad | Preferred | Typical |
|---|---|---|---|
| API | 50–76 | 52–60 | 58 |
| Boiling Range °F. | | | |
| ibp | 50–240 | 90–200 | 95 |
| 10 v % | 120–260 | 145–225 | 145 |
| 50 v % | 200–310 | 210–286 | 210 |
| 90 v % | 300–380 | 305–360 | 351 |
| ep | 320–438 | 360–420 | 400 |
| Sulfur wppm | 300–13,000 | 1100–10,000 | 2,000 |
| Paraffins v % | 25–40 | 30–38 | 36 |
| Naphthenes v % | 5–20 | 10–19 | 16 |
| Aromatics v % | 5–25 | 8–20 | 15 |
| Olefins v % | 20–50 | 25–45 | 33 |
| RON | 60–95 | 73–93 | 91 |

In practice of the process of this invention, the charge naphtha is passed to a bed of hydrodesulfurization catalyst. Although it may be possible to utilize a fluid bed or an ebullated bed, it is preferred to utilize a gravity packed bed.

The catalyst is formed on a support containing a transition alumina. For additional information on transition aluminas, see Catalyst Supports and Support Catalysts—Theoretical and Applied Concepts by A. B. Stiles (1987) Butterworths—Ch 2, page 18; and Industrial Alumina Chemicals by Charakya Misra ACS Monograph 184 (1986) Ch 5, page 73.

The transition aluminas which may be employed as catalyst supports in practice of this invention include those intermediate forms which are formed when the alumina hydrates (particularly the trihydrates or the monohydrates) are thermally dehydrated to form the final anhydrous form: corundum or alpha ($\alpha$) alumina. Alpha alumina (not a transition alumina) is typically formed at about 1000° C.-2300° C. depending on the charge material from which it is prepared.

Gibbsite and Hydrargillite (trihydrates of alumina) when heated to ~250° C.-350° C. are converted to the chi ($\chi$) form and at ~800° C. to the kappa ($\kappa$) form and thence at ~1100° C. to anhydrous corundum alpha ($\alpha$) alumina.

Bayerite and Nordstrandite (also trihydrates) when heated to ~200° C.-350° C. are converted to the eta ($\eta$) form and at ~850° C. to the theta ($\theta$) form and at ~1000° C. to the alpha ($\alpha$) form.

Fast dehydration of the trihydrates, under vacuum or rapid exposure to high temperatures, results in the formation of amorphous rho ($\rho$) alumina which changes to eta ($\eta$) alumina at about 400° C. and to theta ($\theta$) alumina at about 750° C. and to alpha ($\alpha$) alumina at about 1200° C.

Fibrilar boehmite (an alumina monohydrate) when heated to ~450° C.-550° C. is converted to the gamma ($\gamma$) form and at ~900° C. to the theta ($\theta$) form and at ~1100° C. to the alpha form.

Rhombic boehmite follows a similar course except that a delta ($\delta$) form of alumina is observed in the region of ~750° C.-850° C.

The transition alumina which is preferably employed may be:

(i) a member of the Low Temperature or gamma Group including the amorphous rho ($\rho$) or more preferably the chi ($\chi$), eta ($\eta$), or gamma ($\gamma$) aluminas, preferably gamma alumina; or (ii) a member o f the High Temperature Group including the kappa ($\kappa$) theta ($\theta$) or delta ($\delta$) aluminas.

The most preferred transition alumina is theta ($\theta$) alumina.

These transition aluminas may be commercially available or they may be prepared by known processes. Mixtures of transition aluminas may be employed as a support.

Additional information and properties of transition aluminas may be obtained from various sources. See for example Mista, Chanakya *Industrial Alumina Chemicals* ACS Monograph No. 184 American Chemical Society (1986).

These compositions are typically characterized by the following properties:

TABLE

Properties of Charge Transition Aluminas

| Property | Broad | Preferred | Typical |
|---|---|---|---|
| Total Pore Vol. cc/g | 0.8–1 | 0.9–1 | 0.92 |
| Pore Size Dist. cc/g | | | |
| >1500 Å | 0.01–0.2 | 0.01–0.07 | 0.15 |
| >500 Å | 0.03–0.3 | 0.11–0.25 | 0.22 |
| >250 Å | 0.06–0.35 | 0.16–0.3 | 0.24 |
| >100 Å | 0.35–0.90 | 0.4–0.89 | 0.89 |
| <100 Å | 0.030–0.-52 | 0.06–0.19 | 0.06 |
| Pore Mode Å | | | |
| dv/dD Max | 80–140 | 86–125 | 121 |
| BET | 75–140 | 77–130 | 125 |
| Total Surface Area $M^2/g$ | 100–310 | 150–250 | 165 |

Preparation of the catalyst of this invention is effected by contacting the transition alumina support with preferably aqueous solutions of Group VI-B and non-noble Group VIII metal. The non-noble Group VIII metal may be iron Fe, cobalt Co, or nickel Ni, preferably cobalt; and the metal may be added, in solution in amount sufficient to fill the pores of the support—preferably as an aqueous solution of a soluble cobalt salt such as the acetate, nitrate, carbonate, etc. The Group VI-B metal may be chromium Cr, molybdenum Mo, or tungsten W, preferably molybdenum, typically as the acetate, oxide, chloride, or carbonyl. Ammonium molybdate or ammonium heptamolybdate may be employed.

The metals may be added simultaneously or sequentially. After addition, the support bearing the metals is dried at 220° F.-400° F., preferably 250° F.-300° F., say 250° F. for 1-8 hours, preferably 2-6 hours, say 4 hours. Thereafter the catalyst is calcined at 600° F.-1000° F., preferably 700° F.–900° F., say 800° F. for 1–8 hours, preferably 2–6 hours, say 4 hours and thereafter at higher temperature of 800° F.–1200° F., preferably 900° F.–1100° F., say 1010° F. for 0.5–5 hours, preferably 1–3 hours, say 2 hours. The finished catalyst is further characterized as follows (parts by weight) for the oxides.

TABLE

| Component | Broad | Preferred | Typical |
|---|---|---|---|
| Group VIII | 10–25 | 17–20 | 15 |
| Group VI-B | 3–15 | 5–10 | 5 |
| Atom Ratio VIII:VI-B | 1–8 | 2.5–7 | 5.7 |
| Group I-A w % | <1 | 0–0.8 | 0.5 |
| Group II-A w % | <15 | 0–10 | 0.5 |

Other properties of the catalyst may be as follows:

TABLE

| Property | Broad | Preferred | Typical |
|---|---|---|---|
| Total Pore Vol. cc/g | 0.5–0.85 | 0.6–0.8 | 0.69 |
| Pore Size Dist. cc/g | | | |
| >1500 Å | 0.01–0.2 | 0.01–0.15 | 0.11 |
| >500 Å | 0.02–0.25 | 0.02–0.22 | 0.16 |
| >250 Å | 0.15–0.45 | 0.2–0.42 | 0.22 |
| >100 Å | 0.45–0.75 | 0.45–0.7 | 0.63 |
| <100 Å | 0.01–0.3 | 0.01–0.28 | 0.06 |
| Pore Mode Å | | | |
| dv/dD Max | 90–160 | 95–155 | 131 |
| BET | 90–150 | 92–145 | 138 |
| Total Surf. Area $M^2/g$ | 90–250 | 95–220 | 151 |

One preferred catalyst includes:

(i) Transition delta alumina support (ii) 12 w %–20 w % of Group VIII metal oxide (iii) 5 w %–10 w % of $MoO_3$ (iv) 0.5% of Group I-A (v) 0.5% of Group II-A Atom Ratio of VIII to VI-B is 2.5–7:1

Another preferred catalyst includes a support of delta alumina bearing 15 w % CoO and 6 w % $MoO_3$—having an atom ratio of Co:Mo of 4.8:1.

It is a feature of the catalyst systems of this invention that they are particularly characterized by the presence of less than 1 w % of a metal of Group I-A of the Periodic Table, preferably 0–0.8 w %, commonly less than about 0.5 w %. Larger quantities than this tend to yield undesirably lower %HDS and higher %OS (olefin saturation).

It is also a feature of the catalyst systems of this invention that they are particularly characterized by the presence of less than about 15 w % of a metal oxide of Group II-A of the Periodic Table, preferably 0–10 w %, commonly about less than 0.5 w %. Larger quantities tend to yield undesirably lower %HDS and higher %OS.

The content of Group I-A and Group II-A metals is maintained as low as possible; they are not intentionally added.

Selective hydrodesulfurization of cracked naphtha may be effected by passing a charge cracked naphtha in liquid phase through a gravity packed bed of catalyst at the following input conditions:

TABLE

| Conditions | Broad | Preferred | Typical |
|---|---|---|---|
| Temp (°F.) | 450–700 | 500–670 | 550 |
| Total Pressure (psig) | 200–800 | 350–500 | 400 |
| $H_2$ Feed Rate SCFB | 500–2000 | 800–1500 | 1000 |
| $H_2$ Purity v % | 65–100 | 80–99 | 95 |

TABLE-continued

| Conditions | Broad | Preferred | Typical |
|---|---|---|---|
| LHSV | 1–10 | 2–7 | 5 |

During hydrodesulfurization, the sulfur content of the cracked naphtha is decreased from a charge level of 300–13,000 wppm, preferably 1100–10,000 wppm, say 2000 wppm down to a product level of 50–440 wppm, preferably 50–240 wppm, say 56 wppm. The olefin content of the product is typically at least about 75 w %, and frequently as high as 90 w % of that of the charge naphtha.

It is a particular feature of the process of this invention that it is characterized by the following advantages:

(i) It permits attainment of greater hydrodesulfurization activity than is attained by prior art catalysts—typically a %HDS activity of greater than 30% whereas, at comparable conditions, control processes (employing magnesia-containing catalysts) generally show lower activity.

%HDS Activity of a catalyst is the percent hydrodesulfurization measured for a standard weight of sample in a standard hydrodesulfurization test charging a standard charge.

(ii) It permits attainment of high levels of hydrodesulfurization at temperature as low as 550° F. (Control runs using magnesia-containing catalysts must be carried out at temperatures as much as 50° F. higher to obtain comparable HDS Activity). This is particularly desirable in that higher temperatures, particularly above about 680° F., are conducive to undesirable cracking.

(iii) It permits attainment of these high levels of hydrodesulfurization under conditions such that decreased olefin saturation (OS) occurs at accompanying high level of hydrodesulfurization. For example, the instant process operating at 550° F. shows an HDS Activity of 32.9 w % accompanied by an Olefin Saturation of 13.4 w % (at 80% HDS) while a control run operating with a magnesia-containing catalyst at similar conditions shows HDS Activity of only 18.4 w % at Olefin Saturation of 22.8 w % (at 80% HDS). Thus the instant process shows HDS Activity increasing by (32.9/18.4) almost two times at a desirably lower Olefin Saturation of only (13.4/22.8) or 59% of the control (at 80% HDS).

Olefin Saturation (% OS) is measured by the FIA technique (ASTM D-1319) and by the PIONA/PIANO Analyses using gas chromatography techniques.

The product hydrodesulfurized cracked naphtha commonly has a sulfur content as low as 50–440 wppm, preferably 50–240 wppm, say 56 wppm and the sulfur content is 67%–97%, preferably 83%–97%, say 95% lower than that of the charge. The olefin content of the product is typically 3–24 v %, preferably 5–24 v %, say 20 v %.

It is a feature of the process of this invention that the loss in octane number may typically be only 1–9 units, say 8 units. Typical prior art processes show a loss of as much as 14 units.

Practice of the process of this invention will be apparent to those skilled in the art from the following examples wherein all parts are parts by weight unless otherwise specified. An asterisk (*) designates a Control Example.

DESCRIPTION OF SPECIFIC EMBODIMENTS

Example I

In this Example which represents one preferred mode presently known of carrying out the process of this invention, the catalyst support is prepared from the commercially available Haldor Topsoe TK-753 gamma alumina in the form of cylinders of 1.3 mm diameter and 3.8 mm length. Properties of this support are set forth infra.

The charge TK-753 gamma support is converted to delta alumina by calcining at 1742° F. (950° C.) for 2 hours. This transition alumina support (40 parts) is dried overnight at 250° F. and then impregnated at room temperature with an aqueous solution prepared by dissolving 3.5 parts of ammonium heptamolybdate in 38 parts of deionized water and then adding 29.4 parts of nickel nitrate hexahydrate at 140° F. The ratio of total volume of impregnating solution to the total pore volume (TPV of the support as measured by mercury porosimetry) is about 0.97–1.05:1.

The wet support is dried at 250° F. for 4 hours, calcined at 800° F. for 4 hours, and then at 1010° F. for 2 hours.

Properties of the charge alumina, the calcined delta alumina, and the loaded catalyst are as follows:

TABLE

| | EXAMPLE I | | |
|---|---|---|---|
| Property | Charge Alumina | After Calcining | After Loading |
| Phase | Gamma | Delta | Delta |
| TPV cc/g | 0.92 | 0.95 | 0.69 |
| PV >1500 Å cc/g | 0.18 | 0.15 | 0.11 |
| PV >500 Å cc/g | 0.23 | 0.22 | 0.16 |
| PV >250 Å cc/g | 0.30 | 0.29 | 0.22 |
| PV >100 Å cc/g | 0.83 | 0.89 | 0.63 |
| PV <100 Å cc/g | 0.09 | 0.06 | 0.06 |
| PM (@)dv/dD)maxÅ | 120 | 121 | 131 |
| PM (BET) Å | 94 | 125 | 138 |
| TSA $m^2/g$ | 192 | 165 | 151 |
| NiO w % | — | — | 15 |
| $MoO_3$ w % | — | — | 6 |
| Atom Ratio Ni:Mo | | | 4.8 |
| $(Mo/Al)_{int}$ | | | 0.033 |
| $(Ni/Al)_{int}$ | | | 0.046 |
| Mo Gradient | | | 0.79 |
| Ni Gradient | | | 0.91 |

Example II*

In this control Example, the procedure of Example I is followed.

The delta alumina (40 parts) is impregnated, dried, and calcined as is that of Example I except that the impregnating solution contains 1.7 parts of ammonium heptamolybdate and 28.3 parts of nickel nitrate hexahydrate in 38 parts of water.

This Example is a control example because the catalyst has an atom ratio of VIII:VI-B of 9.5:1 which is outside the range of 1–8:1.

Properties of the charge alumina, the calcined alumina, and the loaded catalyst are as follows:

TABLE

| | EXAMPLE II* | | |
|---|---|---|---|
| Property | Charge Alumina | After Calcining | After Loading |
| Phase | gamma | delta | delta |
| TPV cc/g | 0.92 | 0.95 | 0.76 |
| PV >1500 Å cc/g | 0.18 | 0.15 | 0.10 |

TABLE-continued

| | EXAMPLE II* | | |
|---|---|---|---|
| Property | Charge Alumina | After Calcining | After Loading |
| PV >500 Å cc/g | 0.23 | 0.22 | 0.18 |
| PV >250 Å cc/g | 0.30 | 0.29 | 0.24 |
| PV >100 Å cc/g | 0.83 | 0.89 | 0.70 |
| PV <100 Å cc/g | 0.09 | 0.06 | 0.06 |
| PM (@)dv/dD)maxÅ | 120 | 121 | 130 |
| PM (BET) Å | 94 | 125 | 136 |
| TSA $m^2/g$ | 192 | 165 | 151 |
| NiO w % | | | 15 |
| $MoO_3$ w % | | | 3 |
| Atom Ratio Ni:Mo | | | 9.5 |
| $(Mo/Al)_{int}$ | | | 0.011 |
| $(Ni/Al)_{int}$ | | | 0.042 |
| Mo Gradient | | | 1.4 |
| Ni Gradient | | | 0.93 |

Example III

In this Experimental Example, the procedure of Example I is followed except that the support is prepared from the commercially available SN-7063 brand of pseudoboehmite alumina of American Cyanamid Co. in the form of cylinders of 1.3 mm diameter and 3.8 mm length. The charge pseudoboehmite is calcined at 1742° F. (950° F.) for 2 hours to yield a mixture of delta alumina and gamma alumina.

The alumina (228.3 parts) is impregnated, dried, and calcined as is that of Example I except that 228.3 parts of calcined support is impregnated with 230 parts of aqueous solution containing 17.5 parts of ammonium heptamolybdate and 166.7 parts of nickel nitrate hexahydrate.

Properties of the charge alumina, the calcined alumina, and the loaded catalyst are as follows:

TABLE

| | EXAMPLE III | | |
|---|---|---|---|
| Property | Charge Alumina | After Calcining | After Loading |
| Phase | pseudo-boehmite | delta + gamma | delta + gamma |
| TPV cc/g | 0.98 | 0.96 | 0.77 |
| PV >1500 Å cc/g | 0.16 | 0.16 | 0.13 |
| PV >500 Å cc/g | 0.22 | 0.22 | 0.18 |
| PV >250 Å cc/g | 0.26 | 0.28 | 0.22 |
| PV >100 Å cc/g | 0.39 | 0.77 | 0.51 |
| PV <100 Å cc/g | 0.59 | 0.19 | 0.26 |
| PM (@)dv/dD)maxÅ | 65 | 106 | 99 |
| PM (BET) Å | 49 | 105 | 94 |
| TSA $m^2/g$ | 442 | 232 | 208 |
| NiO w % | | | 15 |
| $MoO_3$ w % | | | 5 |
| Atom Ratio Ni:Mo | | | 5.7 |
| $(Mo/Al)_{int}$ | | | 0.023 |
| $(Ni/Al)_{int}$ | | | 0.044 |
| Mo Gradient | | | 1.4 |
| Ni Gradient | | | 1.1 |

Example IV

In this Experimental Example, the support is the American Cyanamid Co. SN-6493 brand of gamma alumina in the form of cylinders of 1.3 mm diameter and 3.8 mm length.

The alumina (50 parts) is impregnated, dried, and calcined as in that of Example I except that the impregnating solution contains 50 parts of aqueous solution containing 3.8 parts of ammonium heptamolybdate and 36.5 parts of nickel nitrate hexahydrate.

Properties of the charge alumina and the finished catalyst are as follows:

TABLE

| EXAMPLE IV | | |
|---|---|---|
| Property | Charge Alumina | After Loading |
| Phase | gamma | gamma |
| TPV cc/g | 0.81 | 0.62 |
| PV >1500 Å cc/g | 0.01 | 0.01 |
| PV >500 Å cc/g | 0.03 | 0.02 |
| PV >250 Å cc/g | 0.06 | 0.41 |
| PV >100 Å cc/g | 0.72 | 0.45 |
| PV <100 Å cc/g | 0.09 | 0.16 |
| PM (@)dv/dD)maxÅ | 119 | 108 |
| PM (BET) Å | 109 | 106 |
| TSA $m^2/g$ | 223 | 195 |
| NiO w % | | 15 |
| $MoO_3$ w % | | 5 |
| Atom Ratio Ni:Mo | | 5.7 |
| $(Mo/Al)_{int}$ | | 0.029 |
| $(Ni/Al)_{int}$ | | 0.043 |
| Mo Gradient | | 0.9 |
| Ni Gradient | | 0.9 |

Example V

This experimental Example is used to demonstrate the preparation of CoMo catalyst on a theta alumina support, which represents the best mode presently known of carrying out the process of this invention.

In this Experimental Example, the procedure of Example I is followed except that the support is prepared from the Haldor-Topsoe Co TK-753 brand of gamma alumina in the form of cylinders of 1.3 mm diameter and 3.8 mm in length. This alumina is converted to a transition alumina containing theta phase by thermal treatment at 1922° F. (1050° C.) for 2 hours.

The transition alumina (25 parts) is impregnated, dried, and calcined as in Example I except that the impregnating solution contains 25 parts of aqueous solution containing 3.8 parts of ammonium heptamolybdate and 18.3 parts of cobalt nitrate hexahydrate.

Properties of the charge alumina, the calcined theta alumina, and the finished catalyst are as follows:

TABLE

| EXAMPLE V | | | |
|---|---|---|---|
| Property | Charge Alumina | After Calcining | After Loading |
| Phase | gamma | theta | theta |
| TPV cc/g | 0.92 | 0.83 | 0.60 |
| PV >1500 Å cc/g | 0.18 | 0.17 | 0.13 |
| PV >500 Å cc/g | 0.23 | 0.22 | 0.17 |
| PV >250 Å cc/g | 0.30 | 0.33 | 0.26 |
| PV >100 Å cc/g | 0.83 | 0.81 | 0.59 |
| PV <100 Å cc/g | 0.09 | 0.02 | 0.01 |
| PM (@)dv/dD)maxÅ | 120 | 134 | 152 |
| M (BET) Å | 94 | 138 | 141 |
| TSA $m^2/g$ | 192 | 111 | 98 |
| CoO w % | | | 15 |
| $MoO_3$ w % | | | 6 |
| Atom Ratio Ni:Mo | | | 4.8 |
| $(Mo/Al)_{int}$ | | | 0.081 |
| $(Co/Al)_{int}$ | | | 0.021 |
| Mo Gradient | | | 15.6 |
| Co Gradient | | | 19.4 |

Example VI

In this Experimental Example VI, the charge alumina is the SN-7063 brand (of American Cyanamid Co) pseudoboehmite alumina in the form of cylinders of 1.3 mm diameter and 3.8 mm in length. Properties of this support are set forth infra.

This alumina is converted to a transition alumina containing a mixture of delta and theta phases by thermal treatment at 1922° F. for 13.5 hours. The so-calcined support (25 parts) is impregnated with 27 parts of aqueous solution containing 4.2 parts of ammonium molybdate and 18.3 parts of nickel nitrate hexahydrate. It is then dried and calcined as in Example I to yield a finished catalyst containing 15 w % NiO, 10 w % $MoO_3$.

Properties of the charge alumina, the calcined alumina, and the loaded catalyst are as follows:

TABLE

| EXAMPLE VI | | | |
|---|---|---|---|
| Property | Charge Alumina | After Calcining | After Loading |
| Phase | pseudo-boehmite | delta + theta | delta + theta |
| TPV cc/g | 0.98 | 0.90 | 0.68 |
| PV >1500 Å cc/g | 0.16 | 0.14 | 0.13 |
| PV >500 Å cc/g | 0.22 | 0.21 | 0.18 |
| PV >250 Å cc/g | 0.26 | 0.28 | 0.24 |
| PV >100 Å cc/g | 0.39 | 0.82 | 0.65 |
| PV >100 cc/g | 0.59 | 0.08 | 0.05 |
| PM (@)dv/dD)maxÅ | 65 | 121 | 125 |
| PM (BET) Å | 49 | 136 | 128 |
| TSA $m^{2/g}$ | 442 | 154 | 132 |
| NiO w % | | | 15 |
| $MoO_3$ w % | | | 10 |
| Atom Ratio Ni:Mo | | | 2.9 |
| $(Mo/Al)_{int}$ | | | 0.095 |
| $(Ni/Al)_{int}$ | | | 0.051 |
| Mo Gradient | | | 15.4 |
| Ni Gradient | | | 6.6 |

Example VII*

In this control Example VII*, the catalyst is prepared to show the effect of potassium as a poison on a NiMo catalyst.

The charge alumina is the SN-7063 brand (of American Cyanamid Co) gamma alumina in the form of cylinders of 1.3 mm diameter and 3.8 mm in length. Properties of this support are set forth infra.

This alumina is converted to a transition alumina containing a mixture of delta and theta phases by thermal treatment at 1992° F. for 13.5 hours. The so-calcined support (50 parts) is impregnated with 53 parts of aqueous solution containing 8.4 parts of ammonium molybdate and 36.5 parts of nickel nitrate hexahydrate. The catalyst is dried at 250° F. for 2 hours and then impregnated with 45 parts of aqueous solution containing 1.9 parts of potassium hydroxide. It is then dried and calcined as in Example I to yield a finished catalyst containing 15 w % NiO, 10 w % $MoO_3$, and 2.4 w % $K_2O$.

Properties of the charge alumina, the calcined alumina, and the loaded catalyst are as follows:

TABLE

| EXAMPLE VII* | | | |
|---|---|---|---|
| Property | Charge Alumina | After Calcining | After Loading |
| Phase | pseudo-boehmite | delta + theta | delta + theta |
| TPV cc/g | 0.98 | 0.90 | 0.63 |
| PV >1500 Å cc/g | 0.16 | 0.14 | 0.11 |
| PV >500 Å cc/g | 0.22 | 0.21 | 0.16 |
| PV >250 Å cc/g | 0.26 | 0.28 | 0.21 |
| PV >100 Å cc/g | 0.39 | 0.82 | 0.57 |
| PV >100 Å cc/g | 0.59 | 0.08 | 0.05 |

TABLE-continued

| Property | EXAMPLE VII* Charge Alumina | After Calcining | After Loading |
|---|---|---|---|
| PM (@)dv/dD)maxÅ | 65 | 121 | 125 |
| PM (BET) Å | 49 | 136 | 122 |
| TSA $m^2/g$ | 442 | 154 | 132 |
| NiO w % | — | | 15 |
| $MoO_3$ w % | — | | 10 |
| $K_2O$ w % | — | | 2.4 |
| Atom Ratio Ni:Mo | — | | 2.9 |
| $(Mo/Al)_{int}$ | — | | 0.064 |
| $(Ni/Al)_{int}$ | — | | 0.050 |
| Mo Gradient | — | | 2.4 |
| Ni Gradient | — | | 2.6 |

Example VIII*

In this control Example VIII*, the procedure of Example I is followed except that the catalyst is prepared by impregnating 50 parts of a transition alumina support, with 55 parts of aqueous solution containing 11.5 parts of ammonium molybdate and 12.2 parts of nickel nitrate hexahydrate. The catalyst is dried and calcined as is Example I.

This catalyst, a control catalyst because it contains 5 w % NiO and 15 w % $MoO_3$, is a typical prior art conventional hydrotreating catalyst. This control Example shows that catalysts with low Ni:Mo ratios (i.e. 0.64:1) do not permit attainment of desired objectives.

Properties of the charge alumina, the calcined alumina, and the loaded catalyst are as follows:

TABLE

| Property | EXAMPLE VIII* Charge Alumina | After Calcining | After Loading |
|---|---|---|---|
| Phase | pseudo-boehmite | delta + gamma | delta + gamma |
| TPV cc/g | 0.98 | 0.96 | 0.77 |
| PV >1500 Å cc/g | 0.16 | 0.16 | 0.13 |
| PV >500 Å cc/g | 0.22 | 0.22 | 0.18 |
| PV >250 Å cc/g | 0.26 | 0.28 | 0.23 |
| PV >100 Å cc/g | 0.39 | 0.77 | 0.66 |
| PV >100 cc/g | 0.59 | 0.19 | 0.11 |
| PM (@)dv/dD)maxÅ | 65 | 106 | 111 |
| PM (BET) Å | 49 | 105 | 89 |
| TSA $n^2/g$ | 442 | 232 | 194 |
| NiO w % | — | — | 5 |
| $MoO_3$ w % | — | — | 15 |
| Atom Ratio Ni:Mo | — | — | 0.64 |
| $(Mo/Al)_{int}$ | — | — | 0.12 |
| $(Ni/Al)_{int}$ | — | — | 0.15 |
| Mo Gradient | — | — | 1.3 |
| Ni Gradient | — | — | 0.9 |

Example IX*

In this control Example IX*, the catalyst is prepared to show the effect of lithium as a poison on a NiMo catalyst.

The charge alumina is the SN-6614 brand (of American Cyanamid Co) lithiated gamma alumina in the form of cylinders of 1.3 mm diameter and 3.8 mm height.

This alumina support (50 parts) is impregnated with 50 parts of aqueous solution containing 11.6 parts of ammonium molybdate and 7.4 parts of nickel nitrate hexahydrate. It is then dried and calcined as in Example I to yield a finished catalyst containing 3 w % NiO, 15 w % $MoO_3$, and 1.0 w % $Li_2O$.

This catalyst is a control because it contains about 1 w % $Li_2O$ and it has a low Ni:Mo atomic ratio (0.39:1).

Properties of the charge alumina and the loaded catalyst are as follows:

TABLE

| Property | EXAMPLE IX* Charge Alumina | After Loading |
|---|---|---|
| Phase | gamma | gamma |
| TPV cc/g | 0.79 | 0.62 |
| PV >250 Å cc/g | 0.06 | 0.04 |
| PV >140 Å cc/g | 0.13 | 0.10 |
| PV <160 Å cc/g | 0.66 | 0.52 |
| PV <100 Å cc/g | 0.08 | 0.04 |
| PV <100-160 Å cc/g | 0.58 | 0.48 |
| PM (@)dv/dD)maxÅ | 125 | 129 |
| PM (BET) Å | 114 | 116 |
| TSA $m^2/g$ | 218 | 174 |
| NiO w % | | 3 |
| $MoO_3$ w % | | 15 |
| $Li_2O$ w % | 1.2 | 1.0 |
| Atom Ratio Ni:Mo | | 0.39 |
| $(Mo/Al)_{int}$ | | 0.10 |
| $(Ni/Al)_{int}$ | | 0.015 |
| Mo Grdient | | 4.1 |
| Ni Gradient | | 0.93 |

Example X*

In this control Example X*, the catalyst is prepared to show the effect of potassium as a poison on a CoMo catalyst.

The charge alumina is the SN-6790 brand (of American Cyanamid Co) gamma alumina in the form of cylinders of 1.3 mm diameter and 3.8 mm height. This gamma alumina support (25 parts) is impregnated with 23 parts of aqueous solution containing 5.8 parts of ammonium molybdate and 3.7 parts of cobalt nitrate hexahydrate. The catalyst is dried at 250° F. for 2 hours and then impregnated with 15 parts of aqueous solution containing 0.88 parts of potassium hydroxide. It is then dried and calcined as in Example I to yield a finished catalyst containing 3 w % CoO, 15 w % $MoO_3$, and 2.3 w % $K_2O$.

This catalyst is a control because it contains 2.3 w % $K_2O$; and it has a low atomic ratio of Group VIII/-Group VI-B (0.39).

Properties of the charge alumina, the calcined alumina, and the loaded catalyst are as follows:

TABLE

| Property | EXAMPLE X* Charge Alumina | After Loading |
|---|---|---|
| Phase | gamma | gamma |
| TPV cc/g | 0.92 | 0.71 |
| PV >1500 Å cc/g | 0.08 | 0.06 |
| PV >500 Å cc/g | 0.12 | 0.10 |
| PV <250 Å cc/g | 0.17 | 0.13 |
| PV <100 Å cc/g | 0.40 | 0.24 |
| PV <100-160 Å cc/g | 0.52 | 0.48 |
| PM (@)dv/dD)maxÅ | 86 | 75 |
| PM (BET) Å | 77 | 72 |
| TSA $m^2/g$ | 309 | 276 |
| CoO w % | | 3 |
| $MoO_3$ w % | | 15 |
| $K_2O$ w % | | 2.3 |
| Atom Ratio Ni:Mo | | 0.39 |
| $(Mo/Al)_{int}$ | | 0.10 |
| $(Co/Al)_{int}$ | | 0.019 |
| Mo Gradient | | 8.8 |
| Co Gradient | | 13.4 |

Example XI*

In this control Example IX*, the catalyst is prepared to show the effect of the presence of magnesium.

The charge support is the SN-1500-S L-3894 brand (of United Catalyst Inc.) mulled magnesia/alumina support prepared by mulling magnesium hydroxide with alpha alumina monohydrate followed by extrusion to yield a product containing about 80 w % MgO and 20 w % alumina. It is dried at 250° F. for 4 hours and calcined at 800° F. for 4 hours and 1010° F. for 2 hours. The so-calcined support (25 parts) is impregnated with 12 parts of impregnating solution containing 5.6 parts of ammonium molybdate and 3.5 parts of cobalt nitrate hexahydrate. It is then dried and calcined as in Example I to yield a finished catalyst containing 3 w % CoO and 15 w % $MoO_3$.

This catalyst is a control because it contains more than 15 w % of a metal oxide of Group II-A; and it has a low atomic ratio of Group VIII:Group VI-B (0.39).

Example XII*

In this control Example XII*, the catalyst is the commercially available K8-11 catalyst of BASF containing 4.3 w % CoO and 13.6 w % $MoO_3$ on a support of magnesia-alumina-silica. It was tested as received.

This catalyst is a control because it contains greater than 15 w % of magnesia; and it has a low atomic ratio of Co:Mo (i.e. 0.61).

In summary, the approximate compositions of the catalysts of these Examples are:

TABLE

| Example | VIII:VI-B Atom Ratio | NiO w % | CoO w % | $MoO_3$ w % | I-A w % | II-A w % |
|---|---|---|---|---|---|---|
| I | 4.8 | 15 | 0 | 6 | — | 0 |
| II* | 9.5 | 15 | 0 | 3 | — | 0 |
| III | 5.7 | 15 | 0 | 5 | — | 0 |
| IV | 5.7 | 15 | 0 | 5 | — | 0 |
| V | 4.8 | — | 15 | 6 | — | 0 |
| VI | 2.9 | 15 | 0 | 10 | — | 0 |
| VII* | 2.9 | 15 | 0 | 10 | 2.4 | 0 |
| VIII* | 0.64 | 5 | 0 | 15 | — | 0 |
| IX* | 0.39 | 3 | 0 | 15 | 1.0 | 0 |
| X* | 0.39 | 0 | 3 | 15 | 2.3 | 0 |
| XI* | 0.39 | 0 | 3 | 15 | — | 66 |
| XII* | 0.61 | 0 | 4.3 | 13.6 | — | 23 |

Examples XIII–XXV*

Each of the catalyst systems of Examples I–XII* is tested in a standard hydrodesulfurization test. The catalyst is ground to 30–60 mesh size, dried in air at 850° F. for 2 hours, and a sample is loaded into the reactor. Presulfiding is carried out at 750° F. for one hour with a gas stream containing 10 v % $H_2S$ in hydrogen. The Model Feed is then admitted for 4 hours at the test temperature and at atmospheric pressure. The Model Feed contains 12 mol % (0.625 molar) benzothiophene in a blend of 67.5 mol % ASTM reagent grade n-heptane with 20.5 mol % 1-hexene. The average hydrodesulfurization activity (from two or more runs) is calculated as the % conversion of benzothiophene to ethylbenzene and in units of %HDS.

In each Example, there are noted (i) the %HDS (which is correlative to the w % of sulfur removed from the charge) and (ii) the OS (which indicates the w % of olefins in the charge which have been saturated).

In a typical instance for example, the noted entry of 40.4/5.5 indicates that, in Example I when run at 550° F., the catalyst removed 40.4 w % of the sulfur which was present in the original charge and simultaneously that 5.5 w % the olefins originally present were hydrogenated to saturated compounds. Thus a high %HDS and a low %OS represent more satisfactory results. The results are tabulated as follows:

TABLE

EXAMPLES XIII–XXV*

| Example | Catalyst of Example | 550° F. | 600° F. | 650° F. | 680° F. |
|---|---|---|---|---|---|
| XIII | I | 40.4/5.5 | 62.6/9.4 | 72.6/11.6 | NA |
| XIV | II* | 18.6/2.0 | 28.8/2.9 | 35.0/3.6 | NA |
| XV | III | 32.5/4.5 | 54.1/7.5 | 63.2/9.2 | NA |
| XVI | IV | 37.4/5.2 | 61.7/9.0 | 73.8/11.5 | NA |
| XVII | V | 32.9/5.1 | 59.4/8.8 | 72.4/13.4 | 82.8/14.9 |
| XVIII | VI | 63.8/10.8 | 90.4/20.5 | 91.2/26.5 | NA |
| XIX* | VII* | 40.4/12.1 | 58.6/12.8 | 74.8/14.6 | NA |
| XX* | VIII* | 92.2/26.9 | 99.9/47.0 | NA/NA | NA |
| XXI* | IX* | 71.1/21.4 | 86.9/33.0 | NA/NA | NA |
| XXII* | X* | 60.1/12.6 | 88.0/20.5 | 99.9/31.6 | NA |
| XXIII* | XI* | 19.0/3.9 | 35.1/5.6 | 57.3/8.2 | 62.5/13.1 |
| XXIV* | XII* | 18.4/4.4 | 39.5/6.8 | 61.3/11.2 | 64.3/13.1 |
| XXV* | XII* (½ LHSV) | 39.8/9.0 | 67.8/17.8 | 85.5/25.7 | NA |

From the above Table, the following conclusions may be noted:

(i) At reaction temperature of 600° F., the process of the instant invention (Examples XIII and XV-XVIII) gives satisfactory hydrodesulfurization compared to the prior art magnesia-containing hydrotreating catalyst as shown by control Example XXIV*.

(ii) At each temperature, the process of the instant invention shows higher degrees of hydrodesulfurization than the prior art magnesia-containing control catalyst of Example XXIV*.

(iii) The catalyst having an atomic ratio of Group VIII to Group VI-B greater than 9 (e.g. Ex. XIV*) gives unsatisfactory levels of HDS.

Examples XXVI–XXXVIII*

In a further series of Examples, each catalyst is studied to determine the degree of olefin saturation (%OS) under conditions at which (i) 50 w % HDS is achieved and (ii) 80 w % HDS is achieved. The degree of HDS is attained by controlling the temperature of operation to yield the desired degree of hydrodesulfurization.

TABLE

EXAMPLES XXVI–XXXVIII

| Example | Catalyst or Example | % OS @ 50% HDS | % OS @ 80% HDS |
|---|---|---|---|
| XXVI | I | 7.0 | 14.5 |
| XXVII* | II* | — | — |
| XXVIII | III | 6.9 | 13.3 |
| XXIX | IV | 7.0 | 13.3 |
| XXX | V | 8.4 | 13.4 |
| XXXI | VI | 8.3 | 15.4 |
| XXXII* | VII* | 12.0 | 15.9 |
| XXXIII* | VIII* | 10.4 | 19.6 |
| XXXIV* | IX* | 13.7 | 27.2 |
| XXXV* | X* | 10.6 | 16.5 |
| XXXVI* | XI* | 9.0 | — |
| XXXVII* | XII* | 9.4 | — |
| XXXVIII* | XII* (½ LHSV) | 11.8 | 22.8 |

It was not possible to achieve about 80% HDS in Examples XXXVI* and XXXVII* at the maximum allowable temperature of 680° F. above which undesirable cracking occurs. The only way to achieve 80%

HDS with magnesia-containing control Example XII* was to lower the space velocity to one half of the normal rate (Example XXXVIII*). In Example XXVII*, it was not possible to achieve 50% HDS or 80% HDS at maximum allowable temperature of 680° F.

From the above Table, the following conclusions may be noted:

(i) At both levels of HDS, the process of the instant invention shows desirably lower degrees of olefin saturation by a substantial factor.

(ii) At lower HDS level (50%) the process of this invention (Examples XXVIII–XXIX) shows degrees of olefin saturation which is lower than that attained by control Examples XXXVI*–XXXVIII*.

(iii) At 50% HDS level, the process of the instant invention (Example XXXI) permits attainment of a lower degree of olefin saturation than the control catalysts containing alkali metal (Example XXXII*, XXXIV* and XXXV*).

(iv) At 80% hydrodesulfurization, the olefin saturation is significantly decreased by about 32%—from 19.6% (control Example XXXIII*) down to 13.3 for the processes of the instant invention (Examples XXVIII–XXIX).

It should be noted that in control Examples XI*–XII* it was not possible to achieve target level of 80% HDS at temperatures less than those which would cause undesirable amounts of cracking (i.e. <680° F.). For control Example IX* at the 80% level of hydrodesulfurization, the degree of olefin saturation is about two-fold greater than the process of the instant invention. Tthe magnesia-containing control Example XII* gave high levels of olefin saturation compared to the process of the instant invention at both normal LHSV (control Example XXXVII*) and ½ LHSV (control Example XXXVIII*).

Examples XXXIX–L*

Analyses of the products from the above-described reactor tests using the PIANO analyses shows that, under the test conditions employed, the n-heptane (n-$C_7$ fraction) passes through unchanged. The feed 1-hexene forms an isomerate with an approximately constant composition of 7.47 w % 1-hexenes (octane number of 69.9), 67.4 w %, 2-hexenes (octane number of 86.8), and 25.2 w % 3-hexenes (octane number of 85.6).

To some degree, this $C_6$ isomerate (average octane number of 85.6) is saturated to form n-hexane (octane number of 25.5). Saturation causes a loss in octane number—defined as 0.5 (RON+MON). The remaining $C_6$ isomerate and the saturated n-hexane form the $C_6$ product fraction.

It is also a feature of the process of this invention that it is characterized by smaller loss in octane number, i.e. (0.5 (RON+MON) for the $C_6$ product fraction.

TABLE VIII

COMPARISON OF OCTANE LOSS OF CATALYSTS AT CONSTANT HDS ACTIVITIES

| Example No. | Catalyst Example No. | % OS @ 50% HDS Octane | Loss | % OS @ 80% HDS Octane | Loss |
|---|---|---|---|---|---|
| XXXIX | I | 81.4 | 4.2 | 76.9 | 8.7 |
| XL* | II* | NA | NA | | |
| XLI | III | 81.5 | 4.1 | 77.6 | 8.0 |
| XLII | IV | 81.4 | 4.2 | 77.6 | 8.0 |
| XLIII | V | 80.6 | 5.0 | 77.5 | 8.0 |
| XLIV | VI | 80.6 | 5.0 | 76.3 | 9.3 |

TABLE VIII-continued

COMPARISON OF OCTANE LOSS OF CATALYSTS AT CONSTANT HDS ACTIVITIES

| Example No. | Catalyst Example No. | % OS @ 50% HDS Octane | Loss | % OS @ 80% HDS Octane | Loss |
|---|---|---|---|---|---|
| XLV* | VII* | 78.4 | 7.2 | 76.0 | 9.6 |
| XLVI* | VIII* | 79.3 | 6.3 | 73.8 | 11.8 |
| XLVII* | IX* | 77.4 | 8.2 | 69.3 | 16.3 |
| XLVIII* | X* | 79.2 | 6.4 | 75.7 | 9.9 |
| XLIX* | XI* | 80.2 | 5.4 | NA | |
| L* | XII* | 80.0 | 5.6 | NA | |
| LI* | XII* (½ LHSV) | 78.5 | 7.1 | 71.9 | 13.7 |

NA: 80% HDS level cannot be achieved at the maximum allowable reaction temperature, 680° F.

NA: 80% HDS level cannot be achieved at the maximum allowable reaction temperature, 680° F.

From the above table, it is apparent that with a $C_6$ olefin charge forming a $C_6$ olefin isomerate having an octane number of 85.6, it is possible to operate (in Examples XLI–XLIII) in accordance with the practice of this invention at high levels of HDS with a loss in octane number of only 8.0 for the $C_6$ product fraction. From the above Table it is also apparent that it is possible to operate (in Example XLIV) in accordance with the practice of this invention at high levels of HDS with a loss in octane number of only 9.3 for the $C_6$ product fraction. It is further apparent from the Table that a catalyst having a ratio of Group VIII to Group VI-B between 3 and 6 gives smaller loss of octane number than a catalyst having the ratio of below 1.

In control Examples XLIX* and L*, the high levels of HDS could not be achieved. In the evaluation of control catalyst Example XLVI*, a greater loss in octane number (11.8) was obtained at high levels of HDS when compared to Examples XLI and XLIII. The addition of alkali metal as seen in catalyst Examples XLV*, XLVII*, and XLVIII* caused a greater loss in octane number. In evaluation of control catalyst Example XLVII* at high levels of HDS a loss in octane number of 16.3 was obtained.

From the above, it is obvious that the prior art catalysts, as typified by control Example XLVII*, suffer a greater loss in octane number compared to the catalyst of the instant invention. It is also obvious that the prior art magnesia-containing catalysts as typified by control Examples XLIX* and L* require a much larger reactor size or much higher temperature to achieve high levels (i.e. ≧80%) of HDS compared to the process of the instant invention. It is also obvious that the prior art magnesia-containing catalyst when run at ½ LHSV (control Example LI*) saturates more olefins than the process of the instant invention running at the normal LHSV (Examples XXIX and XLI–XLIV). It is also apparent that even at low levels of HDS the process of the instant invention saturates less olefins and suffers a lower loss in octane number.

Although this invention has been illustrated by reference to specific embodiments, it will be apparent to those skilled in the art that various charges and modifications may be made which clearly fall within the scope of the invention.

What is claimed is:

1. The process for selective hydrodesulfurization of a charge cracked naphtha containing paraffins, isoparaffins, aromatics, naphthenes, and olefins while reducing olefin saturation which comprises maintaining in a reaction zone a bed of catalyst containing a transition alumina support, containing less than 1 wt % of Group I-A metal oxide, less than about 0.5 wt % of Group II-A metal oxide, and bearing 10–25 wt % of a non-noble metal oxide of Group VIII and 3–15 wt % of a metal oxide of Group VI-B, the atomic ratio of non-noble Group VIII metal to Group VI-B metal being 1–8:1;

passing said cracked naphtha containing paraffins, isoparaffins, aromatics, naphthenes, and olefins to said reaction zone and into contact with said bed of catalyst;

maintaining said bed of catalyst at hydrodesulfurizing conditions thereby producing a product stream, and recovering said product stream of hydrodesulfurized naphtha wherein the olefin content of said product stream is at least about 75 wt % of the olefin content of said charge cracked naphtha to said reaction zone.

2. The process for selective hydrodesulfurization of a charge cracked naphtha containing paraffins, isoparaffins, aromatics, naphthenes, and olefins as claimed in claim 1 wherein said transition alumina is an alpha, delta, gamma, or theta alumina.

3. The process for selective hydrodesulfurization of a charge cracked naphtha containing paraffins, isoparaffins, aromatics, naphthenes, and olefins as claimed in claim 1 wherein said non-noble Group VIII metal is cobalt.

4. The process for selective hydrodesulfurization of a charge cracked naphtha containing paraffins, isoparaffins, aromatics, naphthenes, and olefins as claimed in claim 1 wherein said Group VI-B metal is molybdenum.

5. The process for selective hydrodesulfurization of a charge cracked naphtha containing paraffins, isoparaffins, aromatics, naphthenes, and olefins as claimed in claim 1 wherein the atom ratio of non-noble Group VIII metal to Group VI-B metal is 2.5–7:1.

6. The process for selective hydrodesulfurization of a charge cracked naphtha containing paraffins, isoparaffins, aromatics, naphthenes, and olefins as claimed in claim 1 wherein said hydrodesulfurization conditions include temperature of 450° F.–700° F., total pressure of 200–800 psig, inlet hydrogen purity of 80%–100%, liquid hourly space velocity of 1–10, and hydrogen feed rate of 500–2000 SCFB.

7. The process for selective hydrodesulfurization of a charge cracked naphtha containing paraffins, isoparaffins, aromatics, naphthenes, and olefins as claimed in claim 1 wherein the sulfur content of said charge cracked naphtha is about 300–13,000 wppm.

8. The process for selective hydrodesulfurization of a cracked naphtha containing paraffins, isoparaffins, aromatics, naphthenes and olefins as claimed in claim 1 wherein the octane number 0.5 (RON+MON) of the product stream is about 0–8 units less than the octane number of said charge cracked naphtha.

9. The process for selective hydrodesulfurization of a cracked naphtha containing paraffins, isoparaffins, aromatics, naphthenes, and olefins as claimed in claim 1 wherein said catalyst is characterized by the following:

(i) a Total Surface Area of 100–310 $m^2/g$;

(ii) a Total Pore Volume of 0.8–1 cc/g by mercury porosimetry;

(iii) a content of 10–25 w % of a non-noble metal oxide of Group VIII;

(iv) a content of 3–15 w % of a metal oxide of Group VI-B;

(v) a content of less than 1 w % of Group I-A metal oxide;

(vi) a content of less than about 0.5 w % of Group II-A metal oxide;

(vii) an atom ratio of VIII to VI-B metal of 1–8:1; and (viii) a transition alumina support having a Pore Mode of about 80Å–150Å.

* * * * *